US007303327B2

(12) United States Patent
Copeland et al.

(10) Patent No.: US 7,303,327 B2
(45) Date of Patent: Dec. 4, 2007

(54) DIRECTIONALLY CONTROLLABLE NIGHT LIGHT

(75) Inventors: Steve A. Copeland, Barrie (CA); Mitchell Thompson, Barrie (CA)

(73) Assignee: American Tack + Hardware Co., Inc., Saddle River, NJ (US)

( * ) Notice: Subject to any disclaimer, the term of this patent is extended or adjusted under 35 U.S.C. 154(b) by 0 days.

(21) Appl. No.: 11/274,218

(22) Filed: Nov. 15, 2005

(65) Prior Publication Data

US 2007/0109813 A1 May 17, 2007

(51) Int. Cl.
*F21V 21/26* (2006.01)

(52) U.S. Cl. ..... 362/640; 362/271; 362/282; 362/285; 362/372

(58) Field of Classification Search ..... 362/640, 362/641, 642, 644, 646, 651, 205, 197, 199, 362/200
See application file for complete search history.

(56) References Cited

U.S. PATENT DOCUMENTS

| | | | | |
|---|---|---|---|---|
| 3,203,126 | A | 8/1965 | Eliot | |
| 3,706,004 | A | 12/1972 | Schwartz | |
| 4,344,116 | A | 8/1982 | Martin | |
| 5,410,457 | A * | 4/1995 | Parker | 362/205 |
| 6,390,647 | B1 | 5/2002 | Shaefer | |
| 6,540,376 | B2 * | 4/2003 | Victor | 362/642 |
| 6,561,677 | B1 * | 5/2003 | Leen | 362/276 |
| 6,576,852 | B1 | 6/2003 | Shu | |
| 6,905,231 | B2 * | 6/2005 | Dickie | 362/271 |
| 2002/0141177 | A1 | 10/2002 | Stekelenburg | |
| 2003/0076680 | A1 | 4/2003 | Stekelenburg | |
| 2003/0086266 | A1 | 5/2003 | Leen | |

FOREIGN PATENT DOCUMENTS

| | | |
|---|---|---|
| EP | 0056104 | 7/1982 |
| GB | 1525569 | 9/1978 |
| JP | 7-156711 | 6/1995 |
| JP | 9-282911 | 10/1997 |

* cited by examiner

*Primary Examiner*—Sandra O'Shea
*Assistant Examiner*—Anabel Ton
(74) *Attorney, Agent, or Firm*—Sand & Sebolt

(57) ABSTRACT

A night light comprising a housing with a rotatable bezel mounted thereon. The housing includes a rear wall with electric blades extending outwardly therefrom for engaging in an electrical wall outlet. The bezel is rotatable about a first pivot axis. A LED array is mounted in the bezel and the array is rotatable about a second pivot axis. The second pivot axis is oriented on a different plane to the first pivot axis and preferably lies at ninety degree thereto. When the bezel is rotated about the first pivot axis, the direction of the light emitted from the LED array is changed. Because the bezel can rotate through 360°, the LED array can be rotated through 360° about the first pivot axis. The LED array can be pivoted through an arc of between 160° and 175° about the second pivot axis. The combination of being able to rotationally adjust the position of the bezel on the housing and to adjust the position of the LED array within the bezel allows the individual to control the direction of the light emitted from the night light.

20 Claims, 5 Drawing Sheets

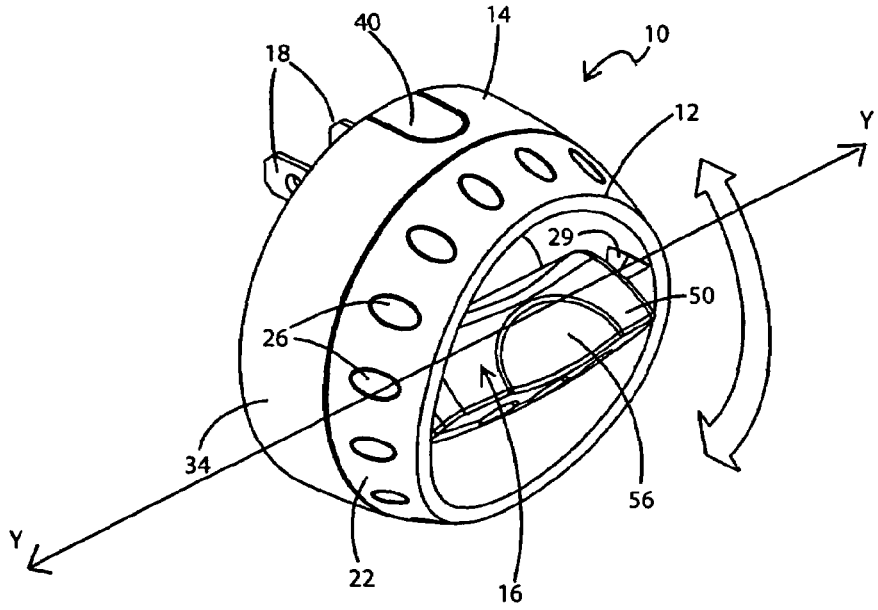
*Fig.* 4
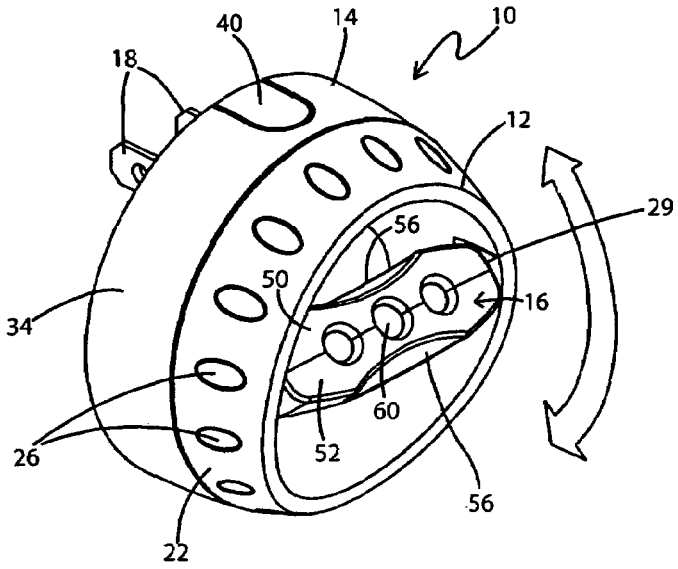
*Fig.* 5

DIRECTIONALLY CONTROLLABLE NIGHT LIGHT

BACKGROUND OF THE INVENTION

1. Technical Field

This invention generally relates to night lights. More particularly, the invention relates to night lights that utilize light-emitting diodes (LEDs) as the source of illumination. Specifically, the invention relates to a night light in which the direction of the emitted light can be controlled by adjusting a portion of the housing and/or by controlling the orientation of the LED array within the housing.

2. Background Information

Night lights are used to provide low levels of light in passageways, bathrooms, kitchens and bedrooms so that people can negotiate their way around the house during the night without having to switch on the overhead lights or lamps and totally illuminate the room.

Most night lights incorporate incandescent light bulbs which emit omnidirectional light. Other night lights incorporate one or more LEDs (light-emitting Diodes) or banks of LEDs which emit a cool light. One of the problems with previously known night lights is that they emit light in many directions which may make it difficult for a person to move about without light from the night light shining into their eyes.

Directionally controlled night lights have been disclosed in the prior art. Some night lights include shields that obscure at least a portion of the light emitted from the light bulb in the night light and thereby permit only a portion of the light to be emitted from the night light in a desired direction.

Other previously known night lights include the night light disclosed in U.S. Pat. No. 6,905,231 to the present inventor, Robert Dickie. In U.S. Pat. No. 6,905,231, there is disclosed a first night light in which a reflector is mounted adjacent the light bulb and the position of the reflector is adjusted to change the direction of the light emitted thereby. A second night light is disclosed in the patent which includes a LED array which can be rotated through a small arc to alter the direction of the light emitted from the array. A third embodiment of night light is disclosed which includes a bezel mounted translucent front face. An incandescent light bulb is mounted within the housing and between the front face and the rear wall thereof. A louvered element is positioned behind the front face of the housing and is rotatable therewith. When the night light is activated, light emitted from the bulb passes through the louvered element and the louvers change the angle of the emitted light relative to the front face. When the front face is rotated, the louvered element is moved in unison therewith and, consequently, the direction of the light emitted from the night light is altered.

Previously known night lights have only allowed for the direction of the light emitted from these devices to be controlled in a limited manner, typically allowing for the direction to be changed through a fairly narrow arc, typically in the order of no more than between 30° and 150°.

There is therefore a need in the art for a night light that allows an individual to alter the direction of the light emitted by the night light through a larger arc and that allows the direction of the light to be altered both vertically and horizontally.

SUMMARY OF THE INVENTION

The device of the present invention therefore comprises a housing with a rotatable bezel mounted thereon. The housing includes a rear wall with electric blades extending outwardly therefrom for engaging in an electrical wall outlet. The bezel is rotatable about a first axis. A LED array is mounted in the bezel and the array is rotatable about a second axis. The second axis is oriented on a different plane to the first axis and preferably lies at ninety degree thereto. When the bezel is rotated about the first axis, the direction of the light emitted from the LED array is changed. Because the bezel can rotate through 360°, the LED array can be rotated through 360° about the first axis. The LED array can be pivoted through an arc of between 160° and 175° about the second axis. The combination of being able to rotationally adjust the position of the bezel on the housing and to also be able to adjust the position of the LED array within the bezel allows the individual to control the direction of the light emitted from the night light.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

FIG. 4 is a perspective view showing the night light with the LED array on the base rotated into a third position;

FIG. 5 is a perspective view showing the night light with the LED array on the base and rotated into a fourth position;

DETAILED DESCRIPTION OF THE INVENTION

Figure 1:
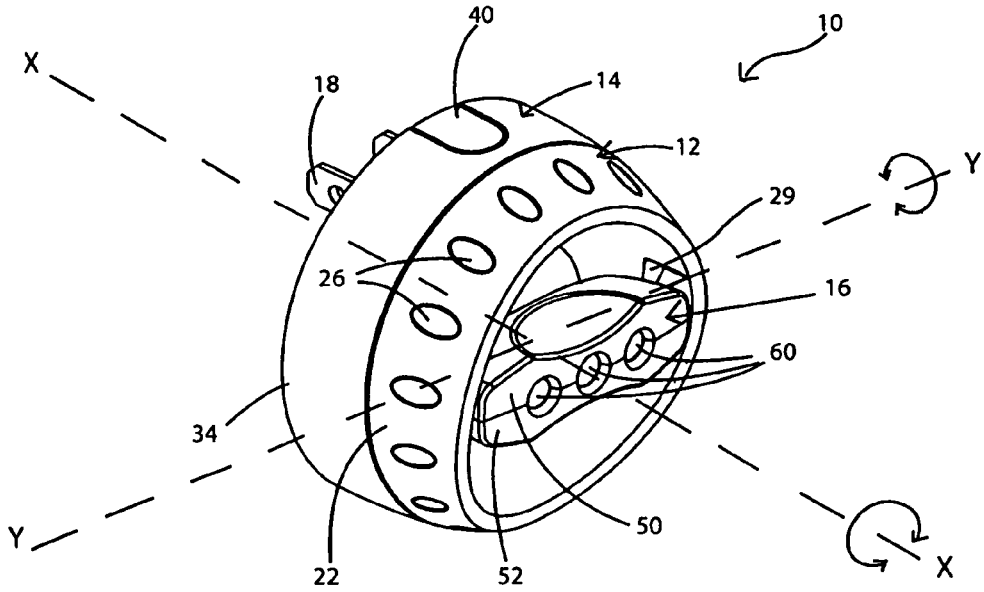
FIG. 1 is a perspective view showing a night light in accordance with the present invention and having a LED array mounted on the gimbaled base within the housing and positioned in a first position.

Referring to FIGS. 1-7, there is shown a night light in accordance with the present invention and generally indicated at 10. Night light 10 comprises a bezel 12 mounted on a housing 14. A narrow LED array 16 is rotatably mounted in bezel 12. Array 16 comprises a plurality of individual LEDs 60 preferably mounted on a member in substantially a straight line. Electrical blades 18 extend outwardly from a rear wall 30 (FIG. 2*a*) of housing 14. As will be subsequently described herein, the direction of the light emitted by the LEDs 60 can be controlled by manipulating the bezel 12 relative to the housing 14 and by manipulating the orientation of the LED array 16 within the bezel 12.

Bezel 12 is a shallow, dish-shaped body which is generally circular in appearance when viewed from the front but, cross-sectionally. The body is deeper proximate a first side 12*a* (FIG. 7) and shallower proximate a second side 12*b*. Bezel 12 comprises a wall 20 having a skirt 22 extending outwardly and rearwardly away from a front edge 24 thereof. Skirt 22 preferably includes a plurality of ridges or indentations 26 on its outer surface to make the skirt 22 easy to grasp in order to rotate bezel 12. A tubular member 28 extends outwardly and rearwardly away from the rear surface 20*a* of wall 20. Tubular member 28 projects through an aperture 32 in housing 14 when bezel 12 is mounted on housing 14. As may be seen in FIGS. 1 and 6, night light 10 has a longitudinal axis X-X extending through a center line of night light 10 and through tubular member 28 of bezel 12. A pair of recesses 29 are formed in the interior surface 20*b* of wall 20. Recesses 29 are disposed diagonally opposite from each other and are aligned with each other.

Housing 14 is a substantially cylindrical member including a rear wall 30 with a peripheral side wall 34 extending upwardly and outwardly away therefrom and thereby defining a recess 14*a* (FIG. 2) therein. Rear wall 30 further defines at least a pair of slots 31 for receiving electrical blades 18 therethrough and has a central aperture 32 therein. A pair of spring biased detents 33 are disposed adjacent aperture 32. Side wall 34 includes an annular groove 36 disposed proximate a front end of housing 14. Groove 36 constitutes a lip that is received between skirt 22 and wall 20 (FIG. 6) of bezel 12 when bezel 12 and housing 14 are engaged together. When housing 14 and bezel 12 are interlocked, peripheral side wall 34 and skirt 22 are substantially continuous when night light 10 is viewed from the side. Peripheral wall 34 further includes an aperture 38 (FIG. 2) into which a switch 40 is inserted. A locking flange 42 is provided on the interior surface of 34*a* of peripheral side wall 34.

A conductive PCB plate 44 is disposed between bezel 12 and housing 14. Blades 18 extend outwardly from a rear surface of plate 44. Plate 44 also includes a central aperture 46 which aligns with aperture 32 in rear wall 30 of housing 14 and with tubular member 28 of bezel 12.

Figure 2:
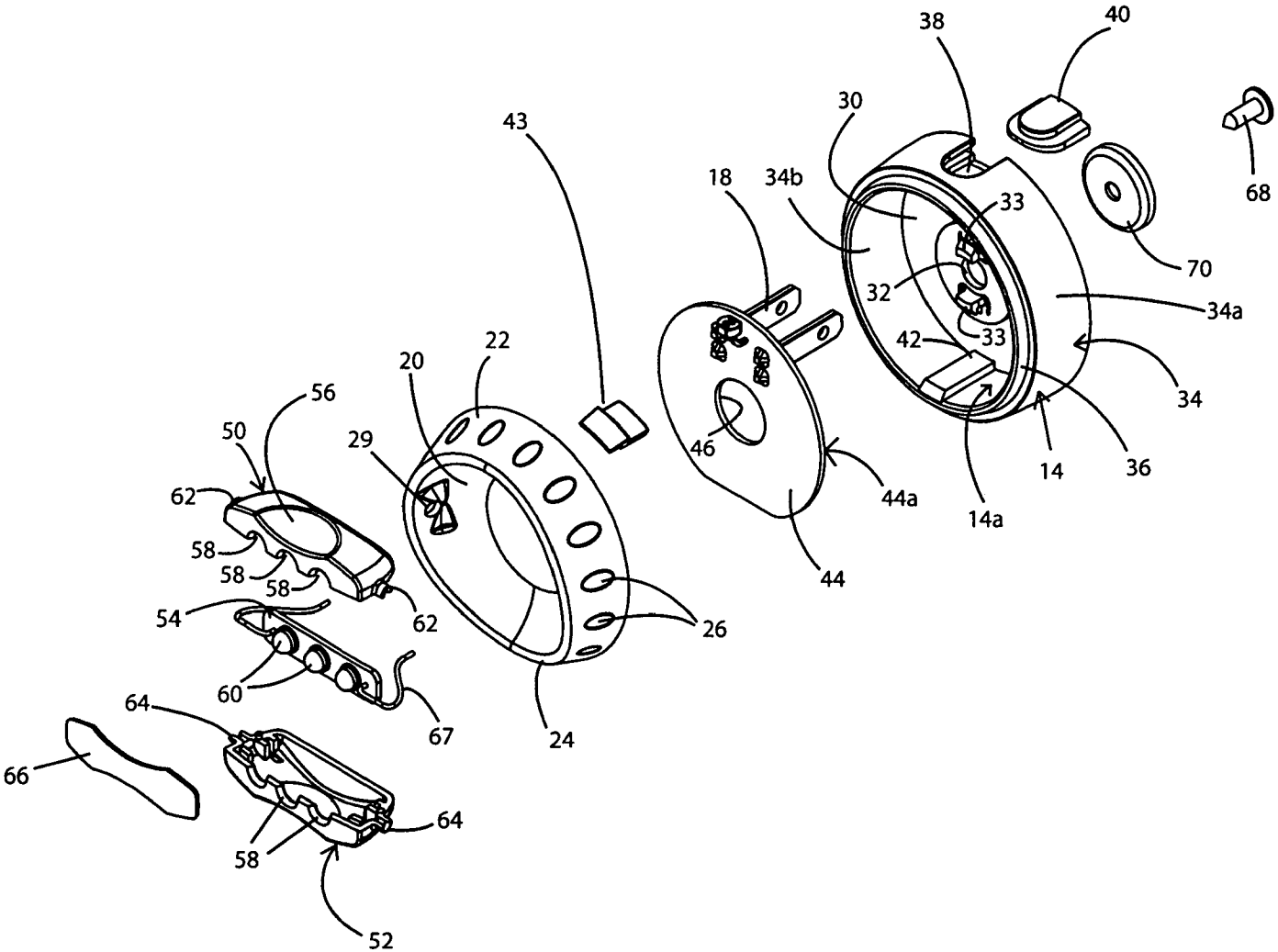
FIG. 2 is an exploded perspective view of the night light viewed from the front.
Figure 2A:
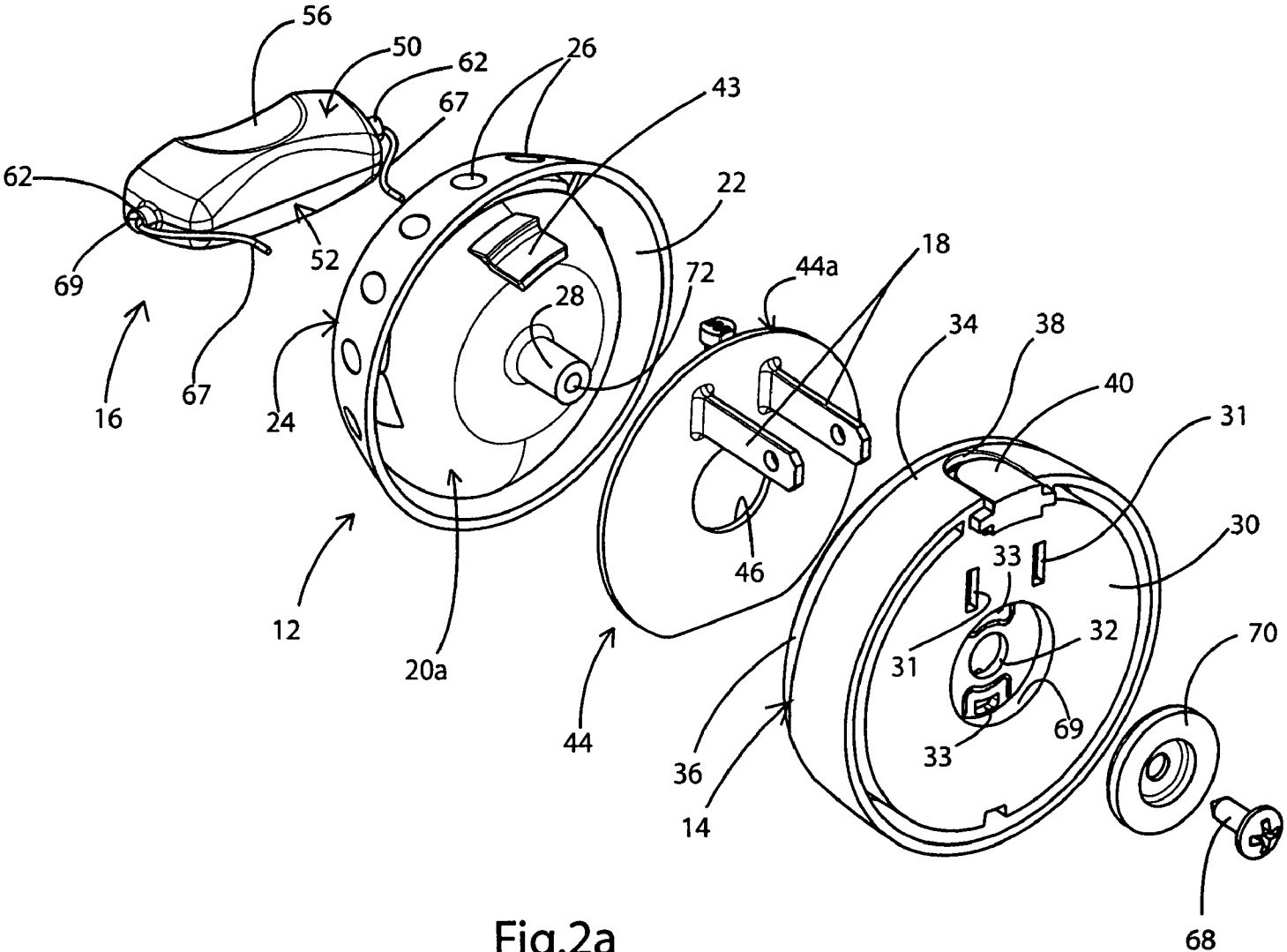
FIG. 2*a* is an exploded perspective view of the night light viewed from the rear.

LED array 16 includes a base made up from an upper housing 50 and a lower housing 52 which are snap fitted together about a LED strip 54. Upper and lower housings 50, 52 are substantially identical, each having a fingertip depression 56 on an outer surface thereof and having a plurality of semi-circular or scalloped indentations 58 formed in the front face thereof. Each individual pair of indentations 58 (when upper and lower housings 50, 52 are fitted together) is shaped to accommodate one of the LED bulbs 60 of the LED strip 54 therein. When light is emitted from array 16, the light rays from each individual LED 60 shines outwardly through scalloped indentations 58. Detents 62 extend outwardly away from opposing side walls of upper housing 50. Detents 64 extend outwardly away from opposing side walls of lower housing 52. Detents 62 and detents 64 are aligned with each other so that when upper and lower housings 50, 52 are snap fitted together, detents 62, 64 are complementary in size and shape to be received within recesses 29 in bezel 12. A lens 66 may be provided within array 16 when upper and lower housings 50, 52 are snap fit together. Lens 66 is positioned in front of LED strip 54. It will be understood that while it has been disclosed that detents 62 and 64 extend outwardly from the upper and lower housings 50, 52 of array 16, a single detent could be formed on the side walls of only one of the upper and lower housings without departing from the spirit of the present invention. Array 16 has a longitudinal axis Y-Y which extends from the detents 62, 64 on one side of array 16 through to the detents 62, 64 on the opposite side of the array. Axis Y-Y lies in a different plane to axis X-X and preferably at ninety degrees thereto as is shown in FIG. 1. Detents 62, 64 are received within recesses 29 in bezel 12 in such a manner that while array 16 is firmly mounted on bezel 12, detents 62, 64 can rotate within recesses 29, thereby allowing array to rotate about the longitudinal axis Y-Y. The rotation of array 16 about axis Y-Y allows the individual to change the angle of the array 16 relative to the interior wall 20*b* of bezel 12. Array 16 can be manipulated manually by an individual in that bezel 12 is free of a front face that would prevent contact with array 16 from outside of night light 10. Electrical wiring 67 extends through an aperture 69 defined by detents 62, 64 and extends through recesses 29 and engages plate 44.

Figure 6:
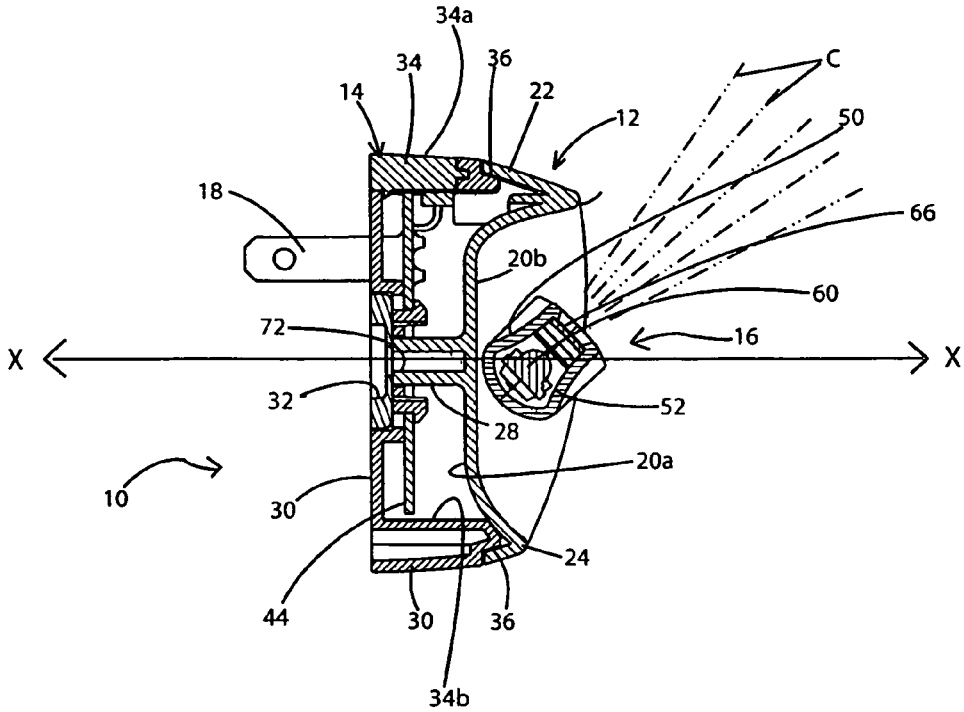
FIG. 6 is a cross-sectional side view of the night light of FIG. 5.
Figure 7:
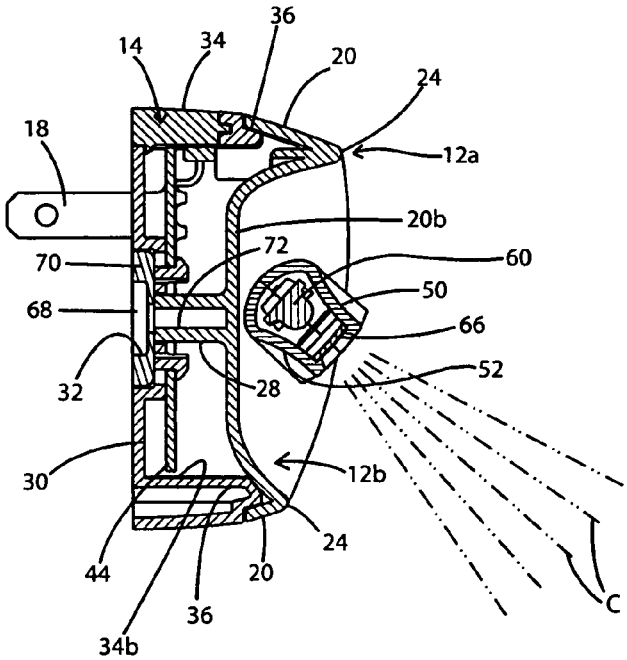
FIG. 7 is a cross-sectional side view of the night light of FIG. 4.

Night light 10 is assembled by connecting the various components together in the following manner. LED array 16 is mounted within bezel 12 such that the electrical wiring 67 extends through apertures 29 and detents 62, 64 engage in the apertures 29. Plate 44 is inserted into housing 14 so that blades 18 are received through slots 31 in rear wall 30 and detents 33 are snap-fitted through aperture 46 in plate 44. Detents 33 prevent plate 44 from accidentally disengaging from housing 14. Stop 43 is secured to bezel 12 so that it extends rearwardly from an interior wall of skirt 22. When bezel 12 is engaged with housing 14, stop 43 slides over peripheral outer edge 44*a* of plate 44 and abuts interior surface 34*b* of housing 14. As seen in FIGS. 6&7, bezel 12 is slid onto grooved lip 36 of housing 14 so that the rear surface 20*a* of wall 20 lies proximate interior surface 34*b* of peripheral side wall 34 and skirt 22 is substantially continuous with exterior surface 34*b* of side wall 34. A fastener 68 (FIGS. 2 & 7) is inserted through a washer 70, through aperture 32 in housing 14, through aperture 46 in plate 44 and into the bore 72 of tubular member 28 of bezel 12. This fastener 68 secures the components together, but allows bezel 12 to rotate relative to housing 14. As may be seen from FIG. 2*a*, rear wall 30 of housing 14 includes a recessed area 69 surrounding aperture 32. When night light 10 is assembled, washer 70 is received within recessed area 69 so that rear wall 30 and washer 70 are substantially coplanar. This allows the rear wall 30 of night light 10 to lie in substantially continuous abutting contact with an outlet wall (not shown). It will be understood that all of the interior wiring of the night light has not been shown for sake of clarity.

With reference mainly to FIGS. 6 & 7, night light 10 is used in the following manner. Night light 10 is inserted into an outlet (not shown) by grasping side wall 34 of housing 14, inserting blades 18 into the outlet and pushing light 10 inwardly until rear wall 30 of housing 14 lies flush against the outlet wall (not shown). Switch 40 is depressed to engage plate 44 and switch night light 10 on. Power is transmitted through electric blades 18, through plate 44 and the electrical wiring (not shown) to array 16. LEDs 60 are powered to emit light and that light is directed straight out of the array 16 as indicated by the dashed lines "C" emanating from array 16. The beams of light "C" travel directly outwardly from each individual LED 60 and are not scattered around as is the case with incandescent light bulbs. Consequently, in order to direct the beams of light "C" in a particular direction, array 16 needs to be oriented in such a way that the LEDs 60 are pointing in that desired direction. If it is desired that the beams of light "C" be directed toward another location, then the LEDs 60 have to be pointing toward that other location. In order to change the direction of light beams "C" emanating from the night light 10, the array 16 has to be reoriented to the desired new direction.

Figure 3:
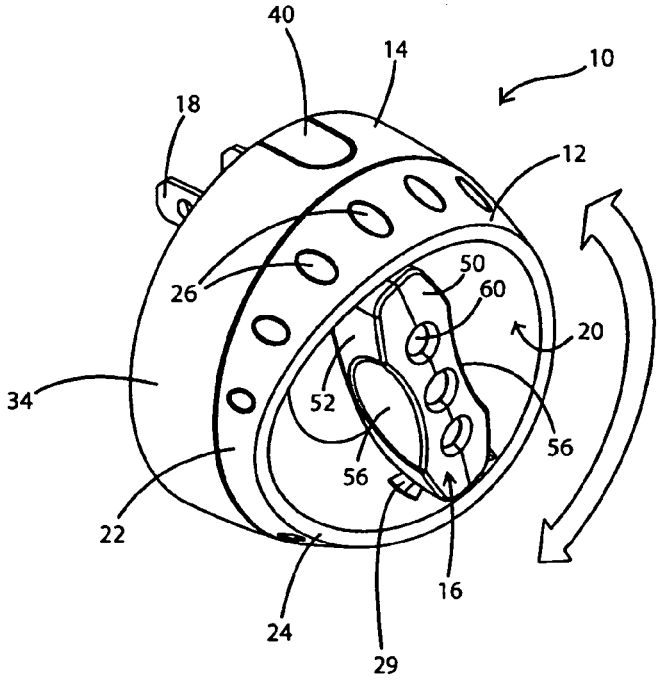
FIG. 3 is a perspective view showing the night light of present invention with the LED array on the base and positioned in a second position.

The first way in which the array 16 can be reoriented is illustrated in FIGS. 1 & 3, where it is shown that the reorientation of array 16 is accomplished by grasping and rotating bezel 12 about its longitudinal axis X-X. This may be accomplished when night light 10 is on or off, although it will, of course, be easier for the individual to see where the light is being directed if night light 10 is switched on. When bezel 12 is rotated about this first axis X-X, housing 14 remains in a fixed position. The individual grasps skirt 22 of bezel 12 and twists their hand to rotate bezel 12 relative to housing 14. Ridges or indentations 26 assist the individual in grasping bezel 12. As bezel 12 rotates, the LED array 16 rotates in unison with bezel 12 because it is mounted therein. If the night light 10 is viewed from the front, the change in orientation of array 16 can be seen. When array 16 is positioned as shown in FIG. 1, beams of light shining out from array 16 will shine out in a horizontal direction. If bezel 12 is then rotated into the position shown in FIG. 3, array 16 is now positioned at approximately 45° relative to its initial horizontal position. Consequently light emitted from the LED's 60 is now directed outwardly at 45° relative to the initial horizontal position. Bezel 12 can be rotated substantially through 360° about longitudinal axis X-X and consequently array 16 can be rotated through 360° about that first axis. Since stop 43 is secured to bezel 12, when bezel 12 rotates, stop 43 rotates with it. When stop 43 engages flange 42 on the interior surface 34*a* of housing 14, any further rotation of bezel 12 in that direction is prevented. Bezel 12 can be rotated in the opposite direction and similarly when stop 43 encounters flange 42, any further rotational movement of bezel 12 in that direction is prevented. Stop 43 consequently limits the travel of bezel 12.

A second way that the array 16 can be oriented in order to control the direction of the light beams emitted therefrom is illustrated in FIGS. 4-7. Here, instead of bezel 12 being rotated about axis X-X, the array 16 itself is rotated about the array's longitudinal axis Y-Y. In order to rotate array 16, the individual uses a thumb and forefinger and grasps the indentations 56 on the upper and lower housings 50, 52 of the array 16. The individual can then rotate the array 16 into the desired new orientation. This can again be accomplished while night light 10 is on or off, although it will, of course, be easier to see where the light is being directed if night light 10 is on. FIG. 5 illustrates an instance where light beams "C" are initially directed upwardly out of night light 10. FIG. 6 shows that array 16 has been rotated around second axis Y-Y through about 45° and the light beams "C" are directed downwardly out of night light 10. The rotational arc of array 16 about second axis Y-Y is limited by the fact that beyond a certain position, light beams will not shine out of night light 10, but will instead reflect off inner surface 20*b* of wall 20. Consequently, while array 16 can potentially be rotated through 360°, practically speaking in order to allow the light emitted by LEDs 60 to exit night light 10, the LED array is only rotated about second axis Y-Y through about 160° to 175°.

It will be understood that the direction of light being emitted by night light 10 can be controlled by manipulating both the bezel 12 and the array 16. An individual can therefore rotate bezel 12 about first axis X-X and rotate array 16 about second axis Y-Y in order to direct beams of light toward any desired location.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A night light comprising:

a housing having a first pivot axis;

a bezel mounted to the housing and being rotatable relative to the housing about the first pivot axis; and wherein said bezel has a second pivot axis;

a light source mounted on the bezel and being adapted to emit a beam of light outwardly therefrom when activated; and wherein the light source is rotatable relative to the bezel about the second pivot axis;

whereby the direction of a beam of light emitted from the night light is controllable by rotating one or both of the bezel and the light source about the respective first and second pivot axes.

2. The night light as defined in claim 1, wherein the first and second pivot axes are different.

3. The night light as defined in claim 1, wherein the first pivot axis is oriented at ninety degrees to the second pivot axis.

4. The night light as defined in claim 1, wherein the bezel is rotatable about the first pivot axis through an arc of substantially 360°.

5. The night light defined in claim 1, wherein the light source is rotatable about the second pivot axis through an arc of between 160° and 175°.

6. The night light defined in claim 1, wherein the light source is mounted within the interior of the bezel.

7. The night light defined in claim 6, wherein the light source is mounted diagonally across to bezel.

8. The night light defined in claim 1, wherein the light source comprises a LED array.

9. The night light defined in claim 8, wherein the LED array includes a plurality of LEDs configured in a straight line.

10. The night light defined in claim 8, wherein the LED array is retained within a base member and the base member is mounted to the bezel; the base member being rotatable about the second pivot axis.

11. The night light as defined in claim 10, wherein the base member comprises:

an upper housing; and a lower housing connectable to the upper housing;

each of the upper and lower housings having a front face with a plurality of scalloped indentations formed therein; and wherein each one of the plurality of LEDs in the array is disposed proximate one of the indentations; whereby the beams of light from the individual LEDs are emitted outwardly through the scalloped indentations.

12. The night light as defined in claim 10, wherein the base member has a pair of opposing side walls and a locking flange extends outwardly from each of that pair of side walls; and wherein the bezel includes a pair of indentations formed in an interior wall thereof, the indentations being positioned diagonally across from each other; the indentations being complementary sized and shaped to retain the locking flanges of the base member therein.

13. The night light as defined in claim 12, wherein the second pivot axis extends between the locking flanges on the base member.

14. The night light as defined in claim 10, wherein each of the upper and lower housings includes an outer wall extending between the side walls; and wherein a depression is formed in the outer wall of at least one of the upper and lower housings; the depression being adapted to receive a fingertip of an individual therein.

15. The night light as defined in claim 14, wherein the outer walls of both the upper and lower housings includes a depression, and the depressions are disposed opposite each other; and whereby the base member is adapted to be grasped between a forefinger and thumb of a individual.

16. The night light as defined in claim 1, wherein the night light further includes a switch for turning the night light on and off.

17. The night light as defined in claim 1, wherein the bezel includes a plurality of grooves formed in an outer surface thereof; whereby the bezel may be more easily grasped for rotation about the first pivot axis.

18. A method of directionally controlling light emitted from a night light, the method comprising:

providing a night light having a housing with a bezel mounted thereon, the bezel being rotatable about a first pivot axis, the night light having a light source mounted on the bezel; the light source being separately rotatable about a second pivot axis that lies at right angles to the first pivot axis;

rotating the bezel about the first pivot axis to position the light source at a desired orientation;

rotating the light source about the second pivot axis to position the light source a desired orientation and to thereby direct light emitted therefrom in the desired direction.

19. The method as defined in claim 18, wherein step of rotating the bezel about the first pivot axis includes the step of grasping an outer surface of the bezel and turning the same until so that the light source is positioned in the desired orientation.

20. The method as defined in claim 18, wherein the step of rotating the light source about the second pivot axis includes the step of grasping the light source and turning the same so that the light source is positioned in the desired orientation.

* * * * *